US006833776B2

(12) United States Patent
Wada et al.

(10) Patent No.: US 6,833,776 B2
(45) Date of Patent: Dec. 21, 2004

(54) DIELECTRIC RESONATOR, DIELECTRIC FILTER, DIELECTRIC DUPLEXER, AND COMMUNICATION DEVICE

(75) Inventors: Takaya Wada, Kyoto (JP); Nobuyuki Sakai, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 168 days.

(21) Appl. No.: 10/346,787

(22) Filed: Jan. 16, 2003

(65) Prior Publication Data

US 2003/0151474 A1 Aug. 14, 2003

(30) Foreign Application Priority Data

Jan. 16, 2002 (JP) ..... 2002-007580

(51) Int. Cl.[7] ..... H01P 7/10

(52) U.S. Cl. ..... 333/219.1; 333/202; 333/206; 333/219

(58) Field of Search ..... 333/219, 219.1, 333/202, 206, 222; 501/122, 127, 134, 136, 137, 152, 153

(56) References Cited

FOREIGN PATENT DOCUMENTS

| | | |
|---|---|---|
| JP | 63-112449 | 5/1988 |
| JP | 02-123790 | 5/1990 |
| JP | 05-315821 | 11/1993 |
| JP | 08-335810 | 12/1996 |

*Primary Examiner*—Robert Pascal
*Assistant Examiner*—Kimberly Glenn
(74) *Attorney, Agent, or Firm*—Dickstein, Shapiro, Morin & Oshinsky, LLP.

(57) ABSTRACT

A dielectric resonator includes a high-frequency dielectric ceramic containing a first ceramic having an adhesive strength of 70 newtons or more per 2 millimeter square to metallic coatings and a second ceramic having an adhesive strength of less than 70 newtons per 2 millimeter square to metallic coatings. The dielectric ceramic has composition in which the condition $10 \leqq \{A/(A+B)\} \times 100 < 100$ is satisfied, where A represents the volume of the first ceramic and B represents the volume of the second ceramic.

17 Claims, 6 Drawing Sheets

DIELECTRIC RESONATOR, DIELECTRIC FILTER, DIELECTRIC DUPLEXER, AND COMMUNICATION DEVICE

BACKGROUND OF THE INVENTION

1. Field of the Invention

The present invention relates to a dielectric resonator, a dielectric filter, a dielectric duplexer, and a communication device including a dielectric ceramic used at high frequencies such as microwaves and millimeter waves.

2. Description of the Related Art

Dielectric ceramics used at high frequencies such as microwaves and millimeter waves are widely used for dielectric resonators, circuit boards, and the like.

A dielectric resonator has a configuration in which copper plating conductors are disposed on a dielectric ceramic. When a metallic coating for providing such copper plating conductors is not tightly joined to the dielectric ceramic, cavities are formed at the interface between the metallic coating and the dielectric ceramic, thus creating a large energy loss and thereby failing to increase the Q factor of the dielectric resonators.

In order to increase the adhesive strength to the metallic coating, the dielectric ceramic undergoes an etching process in general. A technique for improving etching properties is disclosed in Japanese Unexamined Patent Application Publication No. 5-315821. This technique is hereinafter referred to as a first related art.

The first related art relates to a technique for forming a copper coating on a $ZrO_2$—$SnO_2$—$TiO_2$ ceramic. In the first related art, cobalt oxides are added to ceramic materials in an amount of 2–20% by weight, and the mixture is then fired to form a sintered ceramic having cobalt oxide deposits thereon, thereby improving the etching properties. The cobalt oxide deposits are then removed by an etching process to make the ceramic surface rough, thereby increasing the adhesive strength to the copper coating.

Alternatively, the following technique is disclosed in Japanese Unexamined Patent Application Publication No. 8-335810. A ceramic surface is uniformly made rough by an etching process to cause the surface to have a maximum roughness of 1.0–3.0 $\mu$m, thereby obtaining superior plating properties. This technique is hereinafter referred to as a second related art.

However, in the first related art, since firing temperature and atmosphere for obtaining ceramics have significant effects on the deposition of the cobalt oxides, it is difficult to deposit a desired amount of cobalt oxides on a sintered ceramic. Therefore, there is a risk that a difference in adhesive strength to metallic coatings is large. Furthermore, since the amount of removed cobalt oxides varies depending on etching conditions for removing the cobalt oxides, there is a risk that a difference in adhesive strength to metallic coatings is large.

On the other hand, in the second related art, a ceramic surface can be made rough only when ceramics having superior etching properties are used. Thus, there is limitations on ceramic materials. That is, the second related art cannot be used for ceramics having inferior etching properties. Therefore, this art is not effective in obtaining, for example, a dielectric ceramic having a desired dielectric constant in some cases.

SUMMARY OF THE INVENTION

Accordingly, it is an object of the present invention to provide a dielectric resonator, a dielectric filter, a dielectric duplexer, and a communication device including a high-frequency dielectric ceramic used at high frequencies which solves the above problems.

In order to solve the above problems, a high-frequency dielectric ceramic used in the present invention contains a first ceramic having an adhesive strength of 70 newtons or more per 2 millimeter square to metallic coatings and a second ceramic having an adhesive strength of less than 70 newtons per 2 millimeter square to metallic coatings. In the composition of the high-frequency dielectric ceramic, the condition $10 \leqq \{A/(A+B)\} \times 100 < 100$ is satisfied, wherein A represents the volume of the first ceramic and B represents the volume of the second ceramic.

The first ceramic preferably includes an MgO—$TiO_2$ ceramic or a BaO-$Re_mO_n$—$TiO_2$ ceramic, where Re is at least one element selected from the group consisting of La, Pr, Ce, Nd, Sm, Gd, Er, and Y; m=2 and n=3 when Re is at least one element selected from the group consisting of La, Nd, Sm, Gd, Er, and Y; m=6 and n=11 when Re is Pr; and m=1 and n=2 when Re is Ce.

The second ceramic preferably includes at least one ceramic selected from the group consisting of a BaO—$TiO_2$ ceramic, a SrO—$TiO_2$ ceramic, an $Al_2O_3$ ceramic, a MgO—$SiO_2$ ceramic, a $ZrO_2$—$TiO_2$ ceramic, a $SnO_2$—$TiO_2$ ceramic, a $ZrO_2$—$SnO_2$—$TiO_2$ ceramic, and a $Re_2O_3$—$Al_2O_3$ ceramic, where Re is at least one selected from the group consisting of La, Nd, and Sm.

A high-frequency dielectric ceramic used in the present invention preferably has an average grain size of 10 $\mu$m or less.

The present invention provides a dielectric resonator including the dielectric ceramic electromagnetically coupled to input/output terminals so as to function. In the dielectric resonator, the dielectric ceramic described above can be used at high frequencies and has copper plating conductors thereon.

The present invention provides a dielectric filter including the dielectric resonator described above.

The present invention provides a dielectric duplexer including at least two dielectric filters. In the dielectric duplexer, at least one of the dielectric filters includes the dielectric filter describer above.

The present invention provides a communication device including the dielectric duplexer described above, a transmitting circuit connected to an input portion of the dielectric duplexer, a receiving circuit connected to an output portion of the dielectric duplexer, and an antenna connected to an input/output portion of the dielectric duplexer.

DESCRIPTION OF THE PREFERRED EMBODIMENTS

Embodiments of a dielectric resonator, a dielectric filter, a dielectric duplexer, and a communication device including a dielectric ceramic used at high frequencies will now be described.

Figure 1:
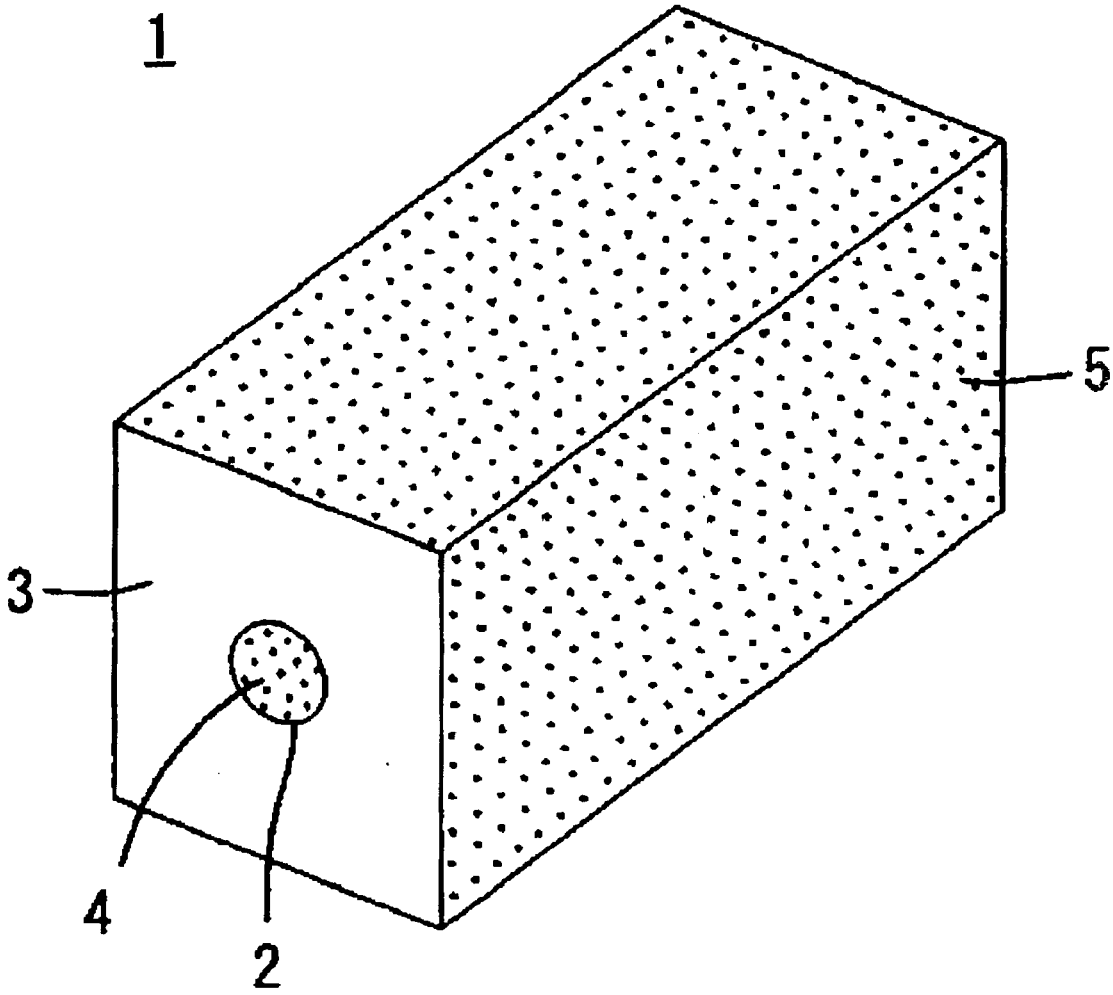
FIG. 1 is a perspective view showing an exemplary dielectric resonator according to the present invention.
Figure 2:
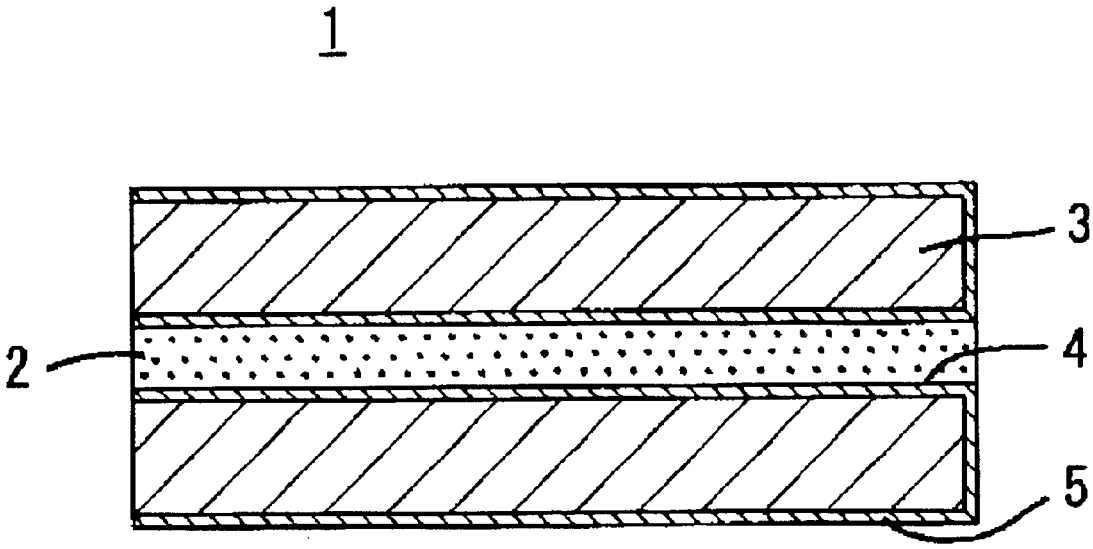
FIG. 2 is a longitudinal sectional view showing the dielectric resonator shown in FIG. 1.

FIG. 1 is a perspective view showing an embodiment of a dielectric resonator including a high-frequency dielectric ceramic. FIG. 2 is a longitudinal sectional view showing the dielectric resonator shown in FIG. 1 taken along the centerline.

The dielectric resonator 1 includes a first dielectric ceramic 3, which is preferably rectangular parallelepiped-shaped, having a first through hole 2. A first internal conductor 4 is disposed over the wall surface of the through hole 2 of the first dielectric ceramic 3, and a first external conductor 5 is disposed over the outer surface.

The dielectric resonator 1 functions when the first dielectric ceramic 3 is electromagnetically coupled to input/output terminals functioning as external coupling device.

The first dielectric ceramic 3 placed in the dielectric resonator 1 includes the high-frequency dielectric ceramic.

The first internal conductor 4 and the first external conductor 5 are copper coatings preferably formed by a plating method, thereby raising the productivity and reducing the manufacturing cost.

The dielectric resonator 1 shown in FIG. 1 including the first dielectric ceramic 3, which is rectangular parallelepiped-shaped, is of a TEM-mode type. Any other dielectric resonators such as TM-mode and TE-mode dielectric resonators may include such a high-frequency dielectric ceramic.

Figure 3:
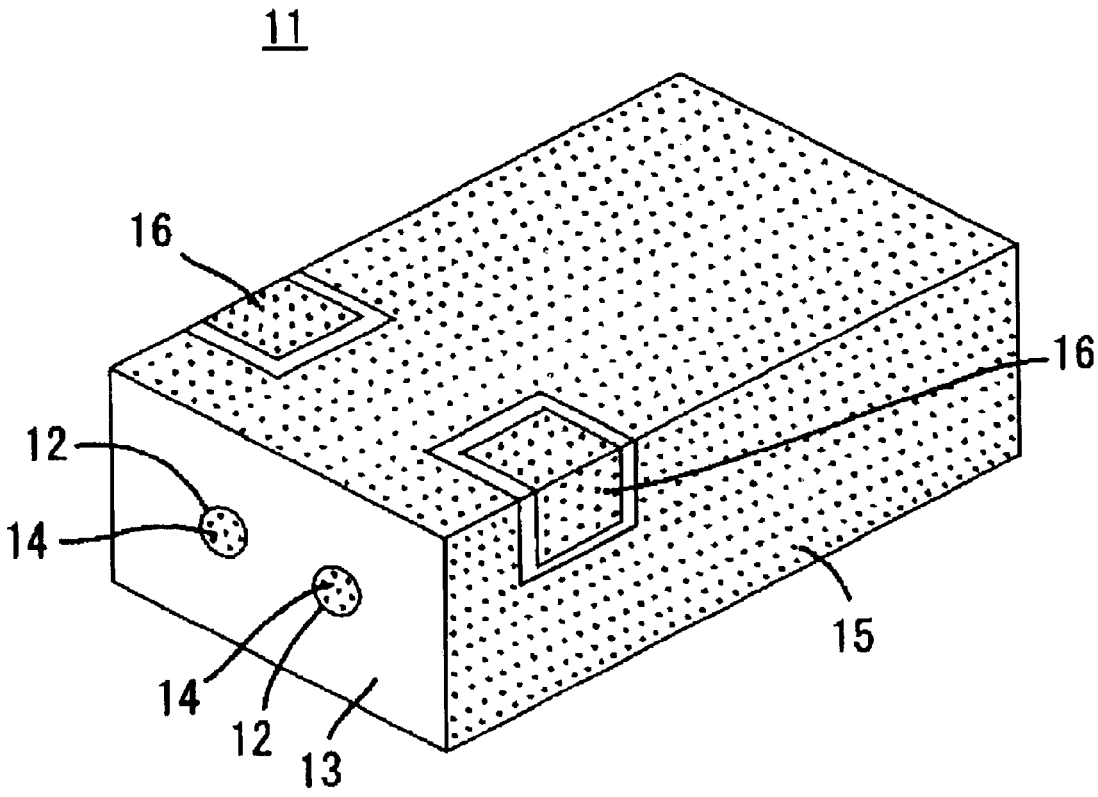
FIG. 3 is a perspective view showing an exemplary dielectric filter according to the present invention.

FIG. 3 is a perspective view showing an embodiment of a dielectric filter including the high-frequency dielectric ceramic.

A first dielectric filter 11 shown in FIG. 3 includes a second dielectric ceramic 13 having second through holes 12. Second internal conductors 14 comprising a copper coating are each disposed over the wall surfaces of the corresponding second through holes 12 of the second dielectric ceramic 13. A second external conductor 15 comprising a copper coating is disposed over the outer surface of the second dielectric ceramic 13.

The second dielectric ceramic 13, the second internal conductors 14, and the second external conductor 15 form a dielectric resonator. This dielectric resonator and first external coupling device 16 form the first dielectric filter 11.

In the first dielectric filter 11, the second dielectric ceramic 13 includes the high-frequency dielectric ceramic.

The first dielectric filter 11 shown in FIG. 3 is of a block type. In discrete-type dielectric filters, the high-frequency dielectric ceramic may be used.

Figure 4:
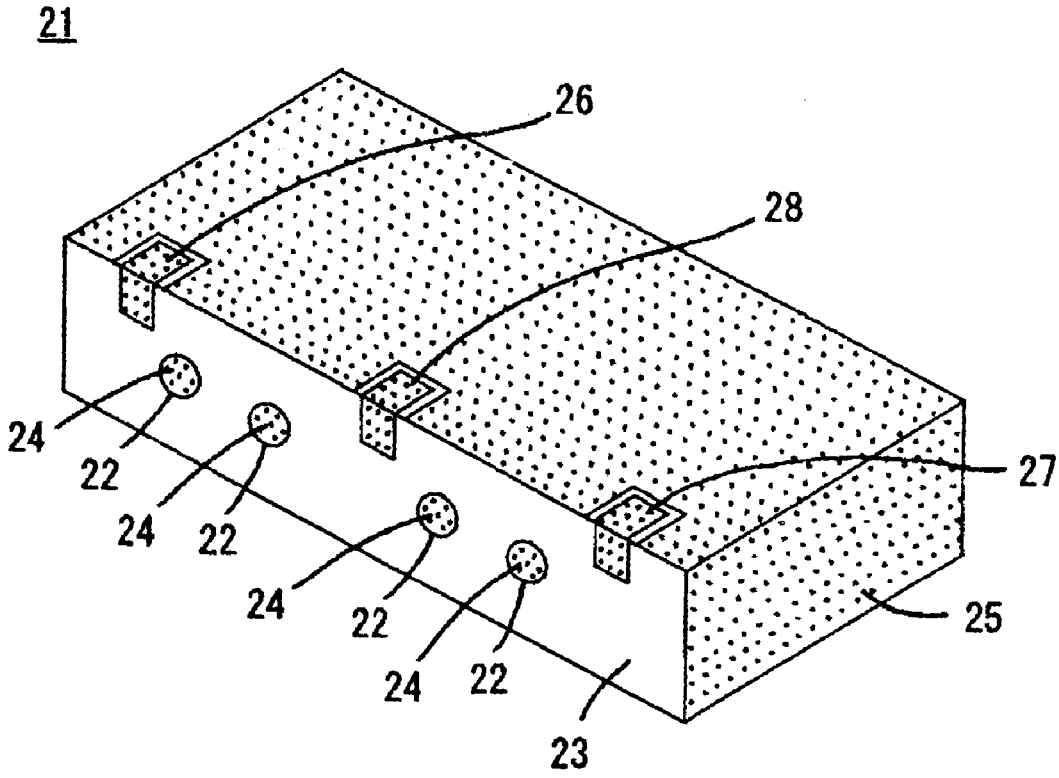
FIG. 4 is a perspective view showing an exemplary dielectric duplexer according to the present invention.

FIG. 4 is a perspective view showing an embodiment of a dielectric duplexer including the high-frequency dielectric ceramic.

A first dielectric duplexer 21 shown in FIG. 4 includes a third dielectric ceramic 23 having third through holes 22. Third internal conductors 24 comprising a copper coating are each disposed over the wall surfaces of the corresponding third through holes 22 of the third dielectric ceramic 23. A third external conductor 25 comprising a copper coating is disposed over the outer surface of the third dielectric ceramic 23.

The third dielectric ceramic 23, the third internal conductors 24, and the third external conductor 25 form two dielectric resonators, which together form a dielectric filter. The first dielectric duplexer 21 further includes a first input-connecting device 26 connected to one dielectric filter, a first output-connecting device 27 connected to the other dielectric filter, and a first antenna-connecting device 28 commonly connected to these dielectric filters.

In the dielectric duplexer 21, the third dielectric ceramic 23 includes the high-frequency dielectric ceramic.

The first dielectric duplexer 21 shown in FIG. 4 is of a block type. In discrete-type dielectric duplexers, the high-frequency dielectric ceramic may be used. In a discrete-type dielectric duplexer, there is no need to use the high-frequency dielectric ceramic for all of a plurality of dielectric filters placed in the discrete-type dielectric duplexer. The high-frequency dielectric ceramic may be used for at least one of the dielectric filters.

Figure 5:
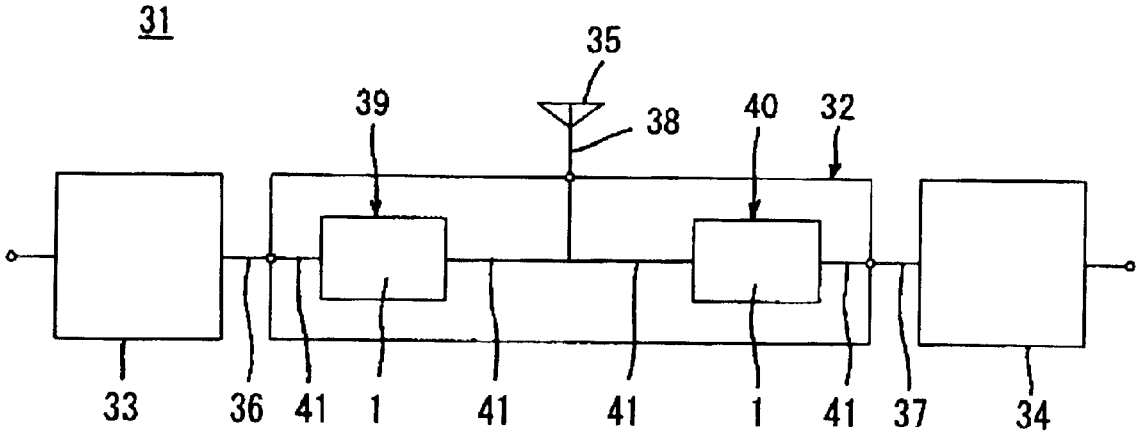
FIG. 5 is a block diagram showing an exemplary communication device including the dielectric resonator shown in the FIG. 1.

FIG. 5 is a block diagram showing an embodiment of a communication device having the dielectric duplexer shown in FIG. 4.

The communication device 31 shown in FIG. 5 includes a second dielectric duplexer 32, a transmitting circuit 33, a receiving circuit 34, and an antenna 35.

The second dielectric duplexer 32 has a second input-connecting device 36, a second output-connecting device 37, and a second antenna-connecting device 38. The transmitting circuit 33 is connected to the second input-connecting device 36, the receiving circuit 34 is connected to the second output-connecting device 37, and the antenna 35 is connected to the second antenna-connecting device 38.

The second dielectric duplexer 32 further includes second and third dielectric filters 39 and 40. The second and third dielectric filters 39 and 40 each have a dielectric resonator 1 and second external coupling device 41 connected thereto. The second dielectric filter 39 is connected to the second input-connecting device 36 and the third dielectric filter 40, which is further connected to the second output-connecting device 37.

The high-frequency dielectric ceramic used for the first dielectric ceramic 3 shown in FIG. 1, the second dielectric ceramic 13 shown in FIG. 3, and the third dielectric ceramic 23 shown in FIG. 4 will now be described in detail.

The high-frequency dielectric ceramic contains a first ceramic having an adhesive strength of 70 newtons or more per 2 millimeter square to metallic coatings and a second ceramic having an adhesive strength of less than 70 newtons per 2 millimeter square to metallic coatings. In the composition of the high-frequency dielectric ceramic, the condition $10 \leqq \{A/(A+B)\} \times 100 < 100$ is satisfied, wherein A represents the volume of the first ceramic and B represents the volume of the second ceramic.

In order to achieve practical performance, the adhesive strength of a ceramic to metallic coatings must be 70 newtons per 2 millimeter square or more, which is a critical value. Therefore, such a value is used in order to distinguish the first and second ceramics.

The term "the adhesive strength of a ceramic to metallic coatings" is herein referred to as a value determined according to "the methods of adhesion test for metallic coatings" specified in Japan Industrial Standard (JIS) H 8504. In particular, the adhesive strength is determined according to the soldering method specified therein.

Figure 6:
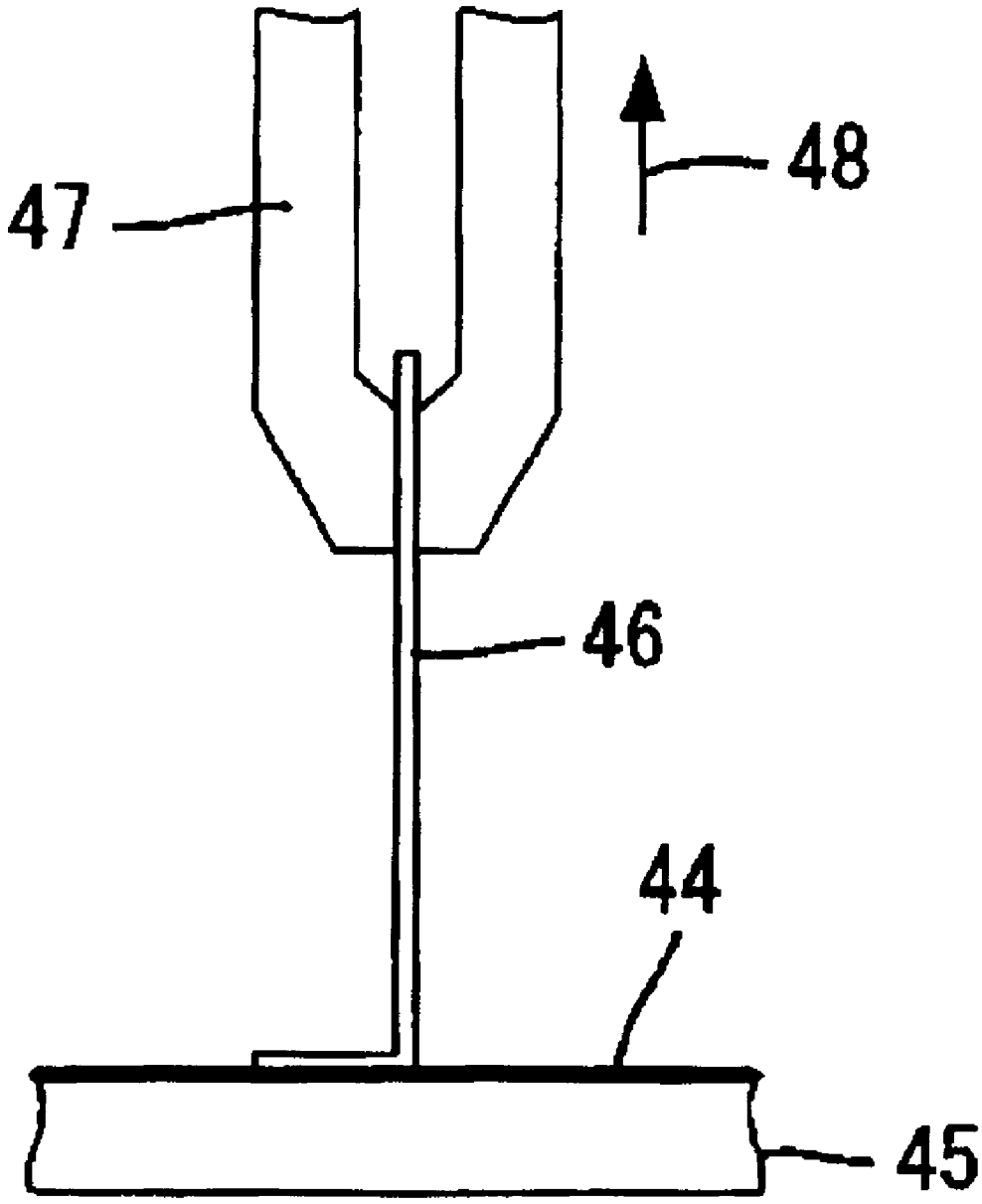
FIG. 6 is a front elevation showing testing equipment used for a method for measuring the adhesive strength to metallic coatings.

With reference to FIG. 6, a test sample 45 has a metallic coating 44 for determining the adhesive strength and a wire 46 has an L shape. The shorter part of the wire 46 is fixed to the metallic coating 44 by soldering with a 2 millimeter square bonding area, and the longer part of the wire 46 is retained with a clamp 47. The clamp 47 is moved in the vertical direction, as indicated by an arrow 48, to pull the wire 46 while the test sample 45 is fixed. The stress applied to the metallic coating 44 when the metallic coating 44 is peeled is determined as the adhesive strength.

The first ceramic, contained in the high-frequency dielectric ceramic, having an adhesive strength of 70 newtons or more per 2 millimeter square to metallic coatings includes an $MgO—TiO_2$ ceramic or a $BaO—Re_mO_n—TiO_2$ ceramic, where m=2 and n=3 when Re is at least one element selected from the group consisting of La, Nd, Sm, Gd, Er, and Y; m=6 and n=11 when Re is Pr; and m=1 and n=2 when Re is Ce.

On the other hand, the second ceramic includes at least one ceramic selected from the group consisting of a $BaO—TiO_2$ ceramic, a $SrO—TiO_2$ ceramic, an $Al_2O_3$ ceramic, a $MgO—SiO_2$ ceramic, a $ZrO_2—TiO_2$ ceramic, a $SnO_2—TiO_2$ ceramic, a $ZrO_2—SnO_2—TiO_2$ ceramic, and a $Re_2O_3—Al_2O_3$ ceramic, where Re is at least one element selected from the group consisting of La, Nd, and Sm.

The high-frequency dielectric ceramic is preferably a sintered body obtained by firing a calcined material having specific composition. In order to obtain the calcined material, the mixture of starting materials for the first and second ceramics may be calcined. Alternatively, starting materials for the first ceramic and starting materials for the second ceramic may be separately calcined and the resulting starting materials may then be mixed. When all starting materials are mixed and the mixture is then calcined, as described in the former method, a compound to be one of the first and second ceramics is first formed and another compound to be the other is then formed. Thus, the same calcined material as that formed by the latter method can be obtained by the former method.

The high-frequency dielectric ceramic preferably has an average grain size of 10 $\mu$m or less. When the average grain size exceeds 10 $\mu$m, the dispersion of the first ceramic into the second ceramic becomes inferior and therefore a difference in adhesive strength to metallic coatings becomes large. Thus, the above size is preferable.

Before a metallic coating is formed on the high-frequency dielectric ceramic, an etching treatment, which is a pretreatment, is performed. In this etching treatment, the dielectric ceramic is soaked in an etching bath at 30–80° C. for 5–20 minutes, wherein the etching bath contains aqueous HF having a concentration of 0.025–1.000 mol/l and aqueous HCl having a concentration of 0.250–3.000 mol/l. The metallic coating is formed by, for example, an electroless plating method.

The high-frequency dielectric ceramic containing the first and second ceramics as main components may further contain $Nb_2O_5$, $Sb_2O_5$, CuO, ZnO, $SnO_2$, $Al_2O_3$, $Fe_2O_3$, $Bi_2O_3$, PbO, $SiO_2$, and $B_2O_3$. In general, the content of these compounds is preferably 5% by weight or less. In particular, among the aforementioned compounds, when the high-frequency dielectric ceramic contains 0.001–0.5% by weight of $Nb_2O_5$ or $SiO_2$, the sintering temperature can be lowered as compared with a high-frequency dielectric ceramic not containing such compounds. Therefore, a change in electrical properties, particularly in a temperature coefficient $\tau_f$ of a resonant frequency, depending on the firing temperature can be reduced.

In the above description, the high-frequency dielectric ceramic is used for a dielectric resonator, a dielectric filter, and a dielectric duplexer. The high-frequency dielectric ceramic can be used for dielectric substrates, capacitors, and so on as long as the electrical properties are satisfied.

Examples made in order to confirm the effects obtained from the high-frequency dielectric ceramic will now be described.

The following powdery starting materials were prepared: $BaCO_3$, $La_2O_3$, $Pr_6O_{11}$, $CeO_2$, $Nd_2O_3$, $Sm_2O_3$, $Gd_2O_3$, $Er_2O_3$, $Y_2O_3$, $Dy_2O_3$, MgO, $TiO_2$, SrO, $Al_2O_3$, $SiO_2$, $ZrO_2$, and $SnO_2$.

The above powdery starting materials were compounded so as to obtain dielectric ceramics for samples containing the first and second ceramics on a volume percentage basis as shown in Tables 1 and 2. Each mixture was calcined at 1000–1200° C. for one hour or more in atmosphere. The fired mixture was crushed and then mixed again. An organic binder was added to the resulting calcined mixture.

The calcined mixture containing the organic binder was formed into a cylindrical body having a diameter of 12 mm and a thickness of 6 mm. The cylindrical body was then fired at 1200–1400° C. in atmosphere to obtain a cylindrical sintered body.

Each cylindrical sintered body, which is used for a sample, was tested to obtain the dielectric constant $\epsilon_r$ at a frequency of 3–7 GHz at 25° C. and the temperature coefficient $\tau_f$ of a resonant frequency at 25–55° C. The results are shown in Tables 1 and 2.

The above calcined mixtures containing the organic binder were each formed into a rectangular parallelepiped body having a width of 3 mm, a length of 3 mm, and a height of 6 mm. Each rectangular parallelepiped body was then fired at 1200–1400° C. in atmosphere to obtain a sintered body having a rectangular parallelepiped shape.

Each obtained sintered body used for a sample was etched according to the procedure described above. A copper coating having a thickness of 2–5 $\mu$m was formed on the sintered body by an electroless plating method using copper to obtain a sample.

Each sample was tuned so as to have a desired resonant frequency and the unloaded Q factor was measured. The adhesive strength to metallic coatings was measured by the method shown in FIG. 6. The results are also shown in Tables 1 and 2.

In Table 1, the samples with the symbol * are outside the scope of the present invention.

In Tables 1 and 2, Samples 1 and 2, which have a volume percentage of a first ceramic of less than 10%, have a unloaded Q factor of less than 300 and an adhesive strength of less than 70 newtons per 2 millimeter square. That is, when the volume percentage of a first ceramic is less than 10%, formed dielectric ceramics have a small area that can be made rough by an etching process with respect to the entire surface area, thereby causing a small adhesive strength to metallic coatings.

In contrast, Samples 3–13 and 15–25, which have a volume percentage of a first ceramic of 10% or more, have an adhesive strength of 70 newtons or more per 2 millimeter

TABLE 1

| Sample | First Ceramic*1 | Second Ceramic*1 | Volume Percentage*2 (Vol %) | $\epsilon_r$ | $\tau_f$ (ppm/° C.) | Unloaded Q | Adhesive Strength (N/2-mm sq.)*3 |
|---|---|---|---|---|---|---|---|
| 1* | $0.15BaO-0.17Sm_2O_3-0.68TiO_2$ | $0.18BaO-0.82TiO_2$ | 5 | 40.1 | 5 | 195 | 52 |
| 2* | | | 8 | 41.3 | 4 | 250 | 66 |
| 3 | | | 10 | 42.5 | 4 | 430 | 75 |
| 4 | | | 15 | 43.6 | 3 | 460 | 84 |
| 5 | | | 25 | 45.1 | 3 | 455 | 94 |
| 6 | | | 35 | 47.3 | 5 | 450 | 117 |
| 7 | | | 50 | 60.0 | 5 | 435 | 119 |
| 8 | | | 75 | 71.2 | 5 | 425 | 122 |
| 9 | $0.15BaO-0.17La_2O_3-0.68TiO_2$ | | 25 | 47.5 | 48 | 420 | 82 |
| 10 | $0.17BaO-0.07Pr_6O_{11}-0.76TiO_2$ | | 25 | 46.2 | 15 | 430 | 85 |
| 11 | $0.13BaO-0.30CeO_2-0.57TiO_2$ | | 25 | 59.5 | 89 | 310 | 74 |
| 12 | $0.15BaO-0.17La_2O_3-0.68TiO_2$ | | 25 | 46.0 | 9 | 440 | 91 |
| 13 | $0.15BaO-0.17Gd_2O_3-0.68TiO_2$ | | 25 | 39.5 | 46 | 370 | 84 |
| 14* | $0.15BaO-0.17Dy_2O_3-0.68TiO_2$ | | 25 | 48.0 | 55 | 250 | 58 |
| 15 | $0.15BaO-0.17Er_2O_3-0.68TiO_2$ | | 25 | 40.4 | 49 | 365 | 80 |
| 16 | $0.15BaO-0.17Y_2O_3-0.68TiO_2$ | | 25 | 48.0 | 55 | 390 | 88 |

*1The coefficient in the following formulae represents the mole ratio.
*2The volume percentage is obtained according to the formula (A/(A + B)) × 100, wherein A represents the volume of the first ceramic and B represents the volume of the second ceramic.
*3The term "N/2-mm sq." represents the unit "newton per 2 millimeter square".

TABLE 2

| Sample | First Ceramic*1 | Second Ceramic*1 | Volume Percentage*2 (Vol %) | $\epsilon_r$ | $\tau_f$ (ppm/° C.) | Unloaded Q | Adhesive Strength (N/2-mm sq.)*3 |
|---|---|---|---|---|---|---|---|
| 17 | $0.15BaO-0.17Sm_2O_3-0.68TiO_2$ | $0.40ZrO_2-0.10SnO_2-0.50TiO_2$ | 25 | 48.5 | 2 | 460 | 90 |
| 18 | | $0.50SnO_2-0.50TiO_2$ | 25 | 52.3 | 185 | 450 | 82 |
| 19 | | $0.50ZrO_2-0.50TiO_2$ | 25 | 51.5 | 39 | 445 | 85 |
| 20 | | $0.50SrO-0.50TiO_2$ | 75 | 136.2 | 410 | 350 | 81 |
| 21 | | $Al_2O_3$ | 25 | 27.4 | −44 | 550 | 80 |
| 22 | | $0.50MgO-0.50SiO_2$ | 25 | 24.8 | −55 | 530 | 82 |
| 23 | | $0.50LaO_{3/2}-0.50AlO_{3/2}$ | 25 | 37.2 | −39 | 480 | 85 |
| 24 | | $0.50NdO_{3/2}-0.50AlO_{3/2}$ | 25 | 36.9 | −33 | 475 | 87 |
| 25 | | $0.50SmO_{3/2}-0.50AlO_{3/2}$ | 25 | 35.0 | −44 | 485 | 86 |
| 26 | $0.49MgO-0.51TiO_2$ | $0.18BaO-0.82TiO_2$ | 25 | 32.8 | −11 | 550 | 82 |
| 27 | | $0.40ZrO_2-0.10SnO_2-0.50TiO_2$ | 25 | 35.0 | −10 | 510 | 78 |
| 28 | | $0.50SnO_2-0.50TiO_2$ | 25 | 36.5 | 176 | 490 | 86 |
| 29 | | $0.50ZrO_2-0.50TiO_2$ | 25 | 34.5 | 30 | 500 | 79 |
| 30 | | $0.50SrO-0.50TiO_2$ | 75 | 90.3 | 384 | 380 | 80 |
| 31 | | $Al_2O_3$ | 25 | 11.6 | −53 | 560 | 81 |
| 32 | | $0.50MgO-0.50SiO_2$ | 25 | 9.1 | −64 | 580 | 80 |
| 33 | | $0.50LaO_{3/2}-0.50AlO_{3/2}$ | 25 | 21.5 | −45 | 520 | 87 |
| 34 | | $0.50NdO_{3/2}-0.50AlO_{3/2}$ | 25 | 20.8 | −40 | 490 | 82 |
| 35 | | $0.50SmO_{3/2}-0.50AlO_{3/2}$ | 25 | 19.3 | −47 | 495 | 85 |

*1The coefficient in the following formulae represents the mole ratio.
*2The volume percentage is obtained according to the formula (A/(A + B)) × 100, wherein A represents the volume of the first ceramic and B represents the volume of the second ceramic.
*3The term "N/2-mm sq." represents the unit "newton per 2 millimeter square".

square, which is a sufficient strength for a practical use, and also have a large unloaded Q factor.

As shown in Table 1, in Samples 3–8, the volume percentage of a first ceramic varies from 10 to 75%. In comparisons of these samples, it is clear that the dielectric constant $\epsilon_r$ can be controlled in a range of about 40 to 70 by changing the volume percentage while the temperature coefficient $\tau_f$ of a resonant frequency is maintained at about 0.

As shown in Table 1, Samples 5 and 9 to 16 are different from each other in species of the component Re in the compound $Re_mO_n$ contained in the first ceramic and have substantially the same composition except for the species. Among these samples, the following samples have a sufficient adhesive strength for a practical use and a large unloaded Q factor: Samples 5, 9, 10, 11, 12, 13, 15, and 16 containing Sm, La, Pr, Ce, Nd, Gd, Er, and Y, respectively, which are represented by Re. In contrast, Sample 14 containing Dy has a small unloaded Q factor and adhesive strength.

As shown in Table 2, Samples 17–25 are different from each other in composition of the second ceramic and the composition is different from that of Samples 3–8 in Table 1. Samples 26–35 in Table 2 are different from each other in composition of the second ceramic.

When Samples 17–25 are compared with each other, Samples 26–35 are compared with each other, and Samples 17–25 are compared with Samples 3–8, it is clear that an adhesive strength sufficient for a practical use and a large unloaded Q factor can be obtained and the dielectric constant $\epsilon_r$ and the temperature coefficient $\tau_f$ of a resonant frequency can be changed in a wide range if the composition of the second ceramic is changed.

As shown in Table 2, the composition of the second ceramic contained in Sample 17 corresponds to that of the combination of the second ceramics contained in Samples 18 and 19. Furthermore, the composition of the second ceramic contained in Sample 27 corresponds to that of the combination of the second ceramics contained in Samples 28 and 29. Samples 17 and 27 with such composition have an adhesive strength sufficient for a practical use and a large unloaded Q factor.

Next, the relationship between the average grain size and the adhesive strength of the dielectric ceramic will now be described.

The above starting materials were compounded so as to obtain samples having the same dielectric ceramic composition as that of Sample 5 in Table 1, and the mixtures were then calcined. The calcined mixtures were fired at different temperatures 1200 to 1450° C. to obtain sintered bodies having different average grain sizes as shown in Table 3. The obtained sintered bodies were used for samples for measuring the adhesive strength to metallic coatings according to the method shown in FIG. 6. The results are shown in Table 3.

TABLE 3

| Sample | Average Grain Size ($\mu$m) | Adhesive Strength (N/2-mm sq.)*1 |
|---|---|---|
| 51 | 2 | 110 |
| 52 | 5 | 92 |
| 53 | 10 | 80 |
| 54 | 15 | 55 |

*1The term "N/2-mm sq." represents the unit "newton per 2 millimeter square".

As shown in Table 3, the average grain size of Sample 54 exceeds 10 $\mu$m and the sample has an adhesive strength of less than 70 newtons per 2 millimeter square, which is small.

In contrast, the average grain size of Samples 51–53 is 10 $\mu$m or less and these samples have an adhesive strength sufficient for a practical use.

As described above, a high-frequency dielectric ceramic of the present invention contains a first ceramic having an adhesive strength of 70 newtons or more per 2 millimeter square to metallic coatings and a second ceramic having an adhesive strength of less than 70 newtons per 2 millimeter square to metallic coatings and has a composition in which the condition $10 \leqq \{A/(A+B)\} \times 100 < 100$ is satisfied, where A represents the volume of the first ceramic and B represents the volume of the second ceramic. Such a dielectric ceramic has electrical characteristics corresponding to an intermediate value between those of the first and second ceramics. Furthermore, the dielectric ceramic has a large adhesive strength to metallic coatings since the first ceramic has a large adhesive strength.

In a case where one of the first and second ceramics contained in the high-frequency dielectric ceramic has small etching characteristics, when the other has high etching characteristics, either ceramic having high etching characteristics can be selectively etched. Therefore, materials that have difficulty being plated by a conventional method because of the low etching characteristics can be readily plated by the above method.

When the dielectric ceramic has a large adhesive strength to metallic coatings, the quantity of cavities at the interface between the dielectric ceramic and a metallic coating is extremely small. Therefore, when such a dielectric ceramic is used for dielectric resonators, dielectric filters, and dielectric duplexers, the energy loss thereof can be greatly reduced, thereby increasing the unloaded Q factor.

Since the high-frequency dielectric ceramic contains the first and second ceramics in a predetermined amount on a volume basis, either ceramic having high etching characteristics can be deposited on the dielectric ceramic in a desired amount independently of firing conditions. Changes in electrical characteristics caused by the etching of the dielectric ceramic can be reduced to a negligible value, because the first and second ceramics are contained in the dielectric ceramic in a uniformly mixed manner. If there is a risk that such changes arise, such a risk can be avoided by controlling the volume of the first and second ceramic.

Accordingly, the following devices have advantages obtained from the dielectric ceramic: a dielectric resonator including the dielectric ceramic, a dielectric filter including such a dielectric resonator, a dielectric duplexer including such a dielectric filter, and a communication device including such a dielectric duplexer.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric resonator comprising:

a dielectric ceramic electromagnetically coupled to input/output terminals; and copper plating conductor disposed on the dielectric ceramic, wherein the dielectric ceramic contains a first ceramic having an adhesive strength of 70 newtons or more per 2 millimeter square to metallic coatings and a second ceramic having an adhesive strength of less than 70 newtons per 2 millimeter square to metallic coatings and has composition in which the condition $10 \leqq \{A/(A+B)\} \times 100 < 100$ is satisfied, where A represents a volume of the first ceramic and B represents a volume of the second ceramic.

2. The dielectric resonator according to claim 1, wherein the first ceramic includes one of an $MgO—TiO_2$ ceramic and a $BaO—Re_mO_n—TiO_2$ ceramic, where Re is at least one element selected from the group consisting of La, Pr, Ce, Nd, Sm, Gd, Er, and Y; m=2 and n=3 when Re is at least one element selected from the group consisting of La, Nd, Sm, Gd, Er, and Y; m=6 and n=11 when Re is Pr; and m=1 and n=2 when Re is Ce.

3. The dielectric resonator according to claim 2, wherein the second ceramic includes at least one ceramic selected from the group consisting of a $BaO—TiO_2$ ceramic, a $SrO—TiO_2$ ceramic, an $Al_2O_3$ ceramic, a $MgO—SiO_2$ ceramic, a $ZrO_2—TiO_2$ ceramic, a $SnO_2—TiO_2$ ceramic, a $ZrO_2—SnO_2—TiO_2$ ceramic, and a $Re_2O_3—Al_2O_3$ ceramic, where Re is at least one element selected from the group consisting of La, Nd, and Sm.

4. The dielectric resonator according to claim 3, wherein the dielectric ceramic has an average grain size of 10 $\mu$m or less.

5. A dielectric filter comprising:

a dielectric resonator according to claim 3.

6. The dielectric resonator according to claim 2, wherein the dielectric ceramic has an average grain size of 10 $\mu$m or less.

7. A dielectric filter comprising:

a dielectric resonator according to claim 2.

8. A dielectric duplexer comprising:

at least two dielectric filters;

wherein at least one of the dielectric filters includes a dielectric filter according to claim 7.

9. The dielectric resonator according to claim 1, wherein the second ceramic includes at least one ceramic selected from the group consisting of a $BaO—TiO_2$ ceramic, a $SrO—TiO_2$ ceramic, an $Al_2O_3$ ceramic, a $MgO—SiO_2$ ceramic, a $ZrO_2—TiO_2$ ceramic, a $SnO_2—TiO_2$ ceramic, a $ZrO_2—SnO_2—TiO_2$ ceramic, and a $Re_2O_3—Al_2O_3$ ceramic, where Re is at least one element selected from the group consisting of La, Nd, and Sm.

10. The dielectric resonator according to claim 9, wherein the dielectric ceramic has an average grain size of 10 $\mu$m or less.

11. A dielectric filter comprising:

a dielectric resonator according to claim 9.

12. A dielectric duplexer comprising:

at least two dielectric filters;

wherein at least one of the dielectric filters includes a dielectric filter according to claim 11.

13. A communication device comprising:

a dielectric duplexer according to claim 12;

a transmitting circuit connected to an input portion of the dielectric duplexer;

a receiving circuit connected to an output portion of the dielectric; and an antenna connected to an input/output portion of the dielectric duplexer.

14. The dielectric resonator according to claim 1, wherein the dielectric ceramic has an average grain size of 10 $\mu$m or less.

15. A dielectric filter comprising:

a dielectric resonator according to claim 1.

16. A dielectric duplexer comprising:

at least two dielectric filters;

wherein at least one of the dielectric filters includes a dielectric filter according to claim 15.

17. A communication device comprising:

a dielectric duplexer according to claim 16;

a transmitting circuit connected to an input portion of the dielectric duplexer;

a receiving circuit connected to an output portion of the dielectric; and an antenna connected to an input/output portion of the dielectric duplexer.

* * * * *